US006603440B2

(12) United States Patent
Howard

(10) Patent No.: US 6,603,440 B2
(45) Date of Patent: Aug. 5, 2003

(54) ARRAYED-SEGMENT LOOP ANTENNA

(75) Inventor: David Amundson Howard, Newark, CA (US)

(73) Assignee: Protura Wireless, Inc., Half Moon Bay, CA (US)

( * ) Notice: Subject to any disclaimer, the term of this patent is extended or adjusted under 35 U.S.C. 154(b) by 0 days.

(21) Appl. No.: 09/738,906

(22) Filed: Dec. 14, 2000

(65) Prior Publication Data

US 2002/0113739 A1 Aug. 22, 2002

(51) Int. Cl.[7] ..... H01Q 1/24

(52) U.S. Cl. ..... 343/866; 343/702

(58) Field of Search ..... 343/866, 732, 343/731, 741, 895, 702, 792.5, 787, 806, 846

(56) References Cited

U.S. PATENT DOCUMENTS

| | | | | | |
|---|---|---|---|---|---|
| 4,381,566 | A | * | 4/1983 | Kane | 455/193 |
| 5,113,196 | A | * | 5/1992 | Ponce de Leon et al. | 343/744 |
| 5,767,813 | A | | 6/1998 | Verma | 343/744 |
| 5,784,032 | A | | 7/1998 | Johntson | 343/702 |
| 6,104,349 | A | | 8/2000 | Cohen | |
| 6,107,975 | A | | 8/2000 | Brennan et al. | 343/853 |
| 6,147,655 | A | | 11/2000 | Roesner | 343/741 |

OTHER PUBLICATIONS

Gianvittorio, John P., et al., "Fractal Element Antennas: A Compliation of Configurations with Novel Characteristics", IEEE Antennas and Propogation Society Int'l Symposium, pp. 1688–1691, vol. 3, XP002203599 2000, Piscataway, NJ, IEEE USA.

G. Nicolaidis, E. Agboraw, O. Leisten, Y. Vardaxoglou, *A Miniature Dielectric–loaded Antenna with Low SAR*, ICT 98 (International Conference for Telecommunication), Porto Carras, Greece Jun. 21–25, 1998, vol. 3 pp. 376–379.

O. Leisten, B. Rosenberger, *Miniature Dielectric–loaded Personal Telephone Antennas with low SAR*, 10$^{th}$ International Conference on Wireless Communications, Jul. 6–8, 1998, Calgary, Canada, vol. 1, pp. 196–205.

O. Leisten, Y. Vardaxoglou, T. Schmid, B. Rosenberger, E. Agboraw, N. Kuster, G. Nicolaidis, *Miniature Dielectric–loaded Personal Telephone Antennas with Low User Exposure*, Electronics Letters, Aug. 20, 1998, vol. 34, No. 17, pp. 1628–1629.

J.D. Kraus, *Electromagnetics*, 4$^{th}$ Edition, Mc–Graw–Hill, New York, 1991, Chapter 15 Antennas and Radiation, pp. 716–767.

* cited by examiner

*Primary Examiner*—James Clinger
(74) *Attorney, Agent, or Firm*—David E. Lovejoy

(57) ABSTRACT

A segmented loop antenna formed of many segments connected in an electrical loop where the segments are arrayed in multiple divergent directions that tend to increase the antenna electrical length while permitting the overall outside antenna dimensions to fit within the antenna areas of communication devices. The loop antenna operates in a communication device to exchange energy at a radiation frequency and includes a connection having first and second conductors for conduction of electrical current in a radiation loop. The radiation loop includes a plurality of electrically conducting segments each having a segment length. The segments are connected in series electrically connected between said first and second conductors for exchange of energy at the radiation frequency. The loop has an electrical length, $A_l$ that is proportional to the sum of segment lengths for each of said radiation segments and the segments are arrayed in a pattern so that different segments connect at vertices and conduct electrical current in different directions near the vertices.

21 Claims, 7 Drawing Sheets

336.9mm
$4_{9A}$
$3_{9A}$
107.238mm
(4.23in)
0mm
5mm
10mm
15mm
20mm
$3_{9C}$
0.2mm
R2
$4_{9}$-8
$4_{9C}$ 150.4mm 150.4mm
R1
$3_{9B}$
$4_{9B}$ 336.9mm
$4_{10A}$
$3_{10A}$ 150.4mm
$4_{10B}$
$3_{10B}$ 336.9mm
$4_{11A}$
$3_{11A}$ 150.4mm
$3_{11B}$
$4_{11B}$ 150.4mm
$3_{11C}$
$4_{11C}$

FIG. 12A
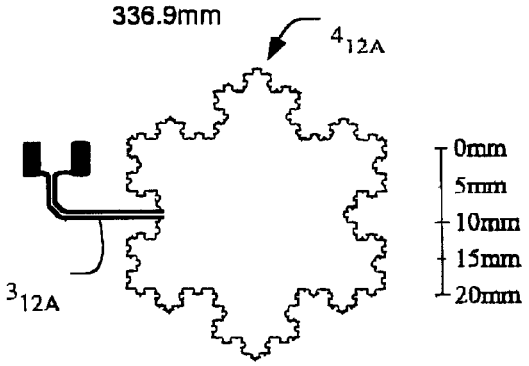
FIG. 12B
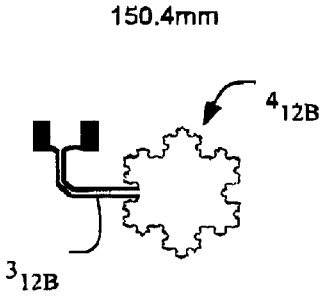
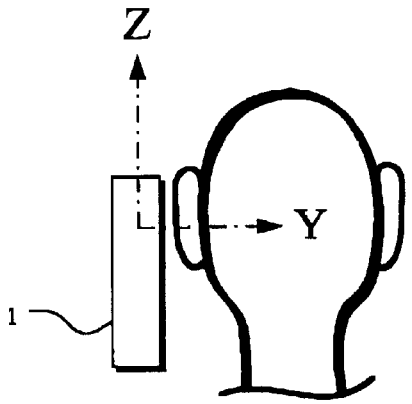
FIG. 13
FIG. 14
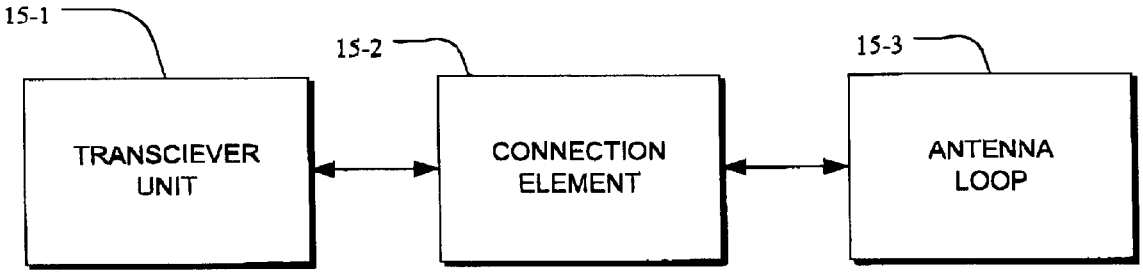

ARRAYED-SEGMENT LOOP ANTENNA

BACKGROUND OF THE INVENTION

The present invention relates to the field of communication devices that communicate using radiation of electromagnetic energy through antennas and particularly relates to portable phones, pagers and other telephonic devices.

Personal communication devices, when in use, are usually located close to an ear or other part of the human body. Accordingly, use of personal communication devices subjects the human body to radiation. The radiation absorption from a personal communication device is measured by the rate of energy absorbed per unit body mass and this measure is known as the specific absorption rate (SAR). Antennas for personal communication devices are designed to have low peak SAR values so as to avoid absorption of unacceptable levels of energy, and the resultant localized heating by the body.

For personal communication devices, the human body is located in the near-field of an antenna where much of the electromagnetic energy is reactive and electrostatic rather than radiated. Consequently, it is believed that the dominant cause of high SAR for personal communication devices is from reactance and electric field energy of the near field. Accordingly, the reactance and electrostatic fields of personal communication devices need to be controlled to minimize SAR.

Antennas Generally

In personal communication devices and other electronic devices, antennas are elements having the primary function of transferring energy to or from the electronic device through radiation. Energy is transferred from the electronic device into space or is received from space into the electronic device. A transmitting antenna is a structure that forms a transition between guided waves contained within the electronic device and space waves traveling in space external to the electronic device. A receiving antenna is a structure that forms a transition between space waves traveling external to the electronic device and guided waves contained within the electronic device. Often the same antenna operates both to receive and transmit radiation energy.

J. D. Kraus "Electromagnetics", 4th ed., McGraw-Hill, New York 1991, Chapter 15 Antennas and Radiation indicates that antennas are designed to radiate (or receive) energy. Antennas act as the transition between space and circuitry. They convert photons to electrons or vice versa. Regardless of antenna type, all involve the same basic principal that radiation is produced by accelerated (or decelerated) charge. The basic equation of radiation may be expressed as follows:

$$IL=Qv(Am/s)$$

where:

I=time changing current (A/s)

L=length of current element (m)

Q=charge (C)

v=time-change of velocity which equals the acceleration of the charge (m/s)

The radiation is perpendicular to the direction of acceleration and the radiated power is proportional to the square of IL or Qv.

A radiated wave from or to an antenna is distributed in space in many spatial directions. The time it takes for the spatial wave to travel over a distance r into space between an antenna point, $P_a$, at the antenna and a space point, $P_s$, at a distance r from the antenna point is r/c seconds where r=distance (meters) and c=free space velocity of light (=3×$10^8$ meters/sec). The quantity r/c is the propagation time for the radiation wave between the antenna point $P_a$ and the space point $P_s$.

An analysis of the radiation at a point $P_s$ at a time t, at a distance r caused by an electrical current I in any infinitesimally short segment at point $P_a$ of an antenna is a function of the electrical current that occurred at an earlier time [t−r/c] in that short antenna segment. The time [t−r/c] is a retardation time that accounts for the time it takes to propagate a wave from the antenna point $P_a$ at the antenna segment over the distance r to the space point $P_s$.

Antennas are typically analyzed as a connection of infinitesimally short radiating antenna segments and the accumulated effect of radiation from the antenna as a whole is analyzed by accumulating the radiation effects of each antenna segment. The radiation at different distances from each antenna segment, such as at any space point $P_s$, is determined by accumulating the effects from each antenna segment of the antenna at the space point $P_s$. The analysis at each space point $P_s$ is mathematically complex because the parameters for each segment of the antenna may be different. For example, among other parameters, the frequency phase of the electrical current in each antenna segment and distance from each antenna segment to the space point $P_s$ can be different.

A resonant frequency, $f$, of an antenna can have many different values as a function, for example, of dielectric constant of material surrounding antenna, the type of antenna and the speed of light.

In general, wave-length, λ, is given by λ=c/$f$=cT where c=velocity of light (=3×$10^8$ meters/sec), $f$=frequency (cycles/sec), T=1/$f$=period (sec). Typically, the antenna dimensions such as antenna length, $A_r$, relate to the radiation wavelength λ of the antenna.

The electrical impedance properties of an antenna are allocated between a radiation resistance, $R_r$, and an ohmic resistance, $R_o$. The higher the ratio of the radiation resistance, $R_r$, to the ohmic resistance, $R_o$ the greater the radiation efficiency of the antenna.

Antennas are frequently analyzed with respect to the near field and the far field where the far field is at locations of space points $P_s$ where the amplitude relationships of the fields approach a fixed relationship and the relative angular distribution of the field becomes independent of the distance from the antenna.

Antenna Types

A number of different antenna types are well known and include, for example, loop antennas, small loop antennas, dipole antennas, stub antennas, conical antennas, helical antennas and spiral antennas. Such antenna types have often been based on simple geometric shapes. For example, antenna designs have been based on lines, planes, circles, triangles, squares, ellipses, rectangles, hemispheres and paraboloids. Small antennas, including loop antennas, often have the property that radiation resistance, $R_r$, of the antenna decreases sharply when the antenna length is shortened. Small loops and short dipoles typically exhibit radiation patterns of ½λ and ¼λ, respectively. Ohmic losses due to the ohmic resistance, $R_o$ are minimized using impedance matching networks. Although impedance matched small loop antennas can exhibit 50% to 85% efficiencies, their bandwidths have been narrow, with very high Q, for example, Q>50. Q is often defined as (transmitted or received frequency)/(3 dB bandwidth).

An antenna goes into resonance where the impedance of the antenna is purely resistive and the reactive component is 0. Impedance is a complex number consisting of real resistance and imaginary reactance components. A matching network forces a resonance by eliminating the reactive component of impedance for a particular frequency.

Antennas based upon more complex shapes have also been proposed. For example, U.S. Pat. No. 6,104,349 to Cohen and entitled TUNING FRACTAL ANTENNAS AND FRACTAL RESONATORS describes dipole antennas based upon deterministic fractals. Fractals are patterns based upon a plurality of connected segments. Fractal patterns are categorized as random fractals (which are also termed chaotic or Brownian fractals) or deterministic fractals. A deterministic fractal is a self-similar structure that results from the repetition of a design (sometimes called a "motif" or "generator").

Low SAR Antennas

Antenna design involves tradeoffs between antenna parameters including gain, size, efficiency, bandwidth and SAR. When antennas are employed in personal communication devices, size is of paramount importance since the antenna must not be physically obtrusive to the user and SAR must be low to minimize local heating in the body of users.

U.S. Pat. No. 5,784,032 to Johnston et al entitled COMPACT DIVERSITY ANTENNA WITH WEAK BACK NEAR FIELD described three-dimensional antennas with multiple diversity interconnected loops that are described as having weak near fields. However, three-dimensional antennas are somewhat difficult to design into the physical enclosure of compact personal communication devices while still obtaining acceptable parameter values.

In consideration of the above background, there is a need for improved antenna designs that achieve the objectives of low values of SAR, physical compactness suitable for personal communication devices and other acceptable antenna design parameters.

SUMMARY

The present invention is a segmented loop antenna formed of many segments connected in an electrical loop where the segments are arrayed in multiple divergent directions that tend to increase the antenna electrical length while permitting the overall outside antenna dimensions to fit within the antenna areas of communication devices.

The loop antenna operates in a communication device to exchange energy at a radiation frequency and includes a connection having first and second conductors for conduction of electrical current in a radiation loop. The radiation loop includes a plurality of electrically conducting segments each having a segment length. The segments are connected in series electrically connected between said first and second conductors for exchange of energy at the radiation frequency. The loop has an electrical length, $A_t$ that is proportional to the sum of segment lengths for each of said radiation segments and the segments are arrayed in a pattern so that different segments connect at vertices and conduct electrical current in different directions near the vertices.

The arrayed segments that form the loop antenna may be straight or curved and of any lengths. Collectively the arrayed segments appreciable increase antenna electrical lengths while permitting the antenna to fit within the available area of communicating devices. The pattern formed by the antenna segments may be regular and repeating or may be irregular and non-repeating. Mathematically, the pattern of the arrayed-segment loop antenna may be expressed as a continuous function or as a discontinuous function with one or more, and frequently many, directional discontinuities that collectively increase the antenna electrical length while maintaining overall external dimensions of the loop antenna.

The electrical length of the arrayed-segment loop antenna is typically equal to the wavelength, $\lambda$, or integral multiples thereof, of the radiation wave from the antenna. Although the antenna's electrical length is not small compared to $\lambda$, the near field in reactive and electrical fields tend to be low whereby the SAR for the arrayed-segment loop antenna tends to be low.

The arrayed-segment loop antennas are typically located internal to the housings of personal communicating devices where they tend to be less immune to de-tuning due to objects in the near field in close proximity to the personal communicating devices.

The foregoing and other objects, features and advantages of the invention will be apparent from the following detailed description in conjunction with the drawings.

BRIEF DESCRIPTION OF THE DRAWINGS

FIG. 12A depicts a top view of a koch island fractal-shaped loop antenna having a radiation length of about 337 mm together with a transmission line matching element.

FIG. 12B depicts a top view of a koch island fractal-shaped loop antenna having a radiation length of about 150 mm together with a transmission line matching element.

FIG. 13 depicts a the device of FIG. 1 juxtaposed a person's head at the ear.

FIG. 14 depicts the components of the device of FIG. 1.

DETAILED DESCRIPTION

Figure 1:
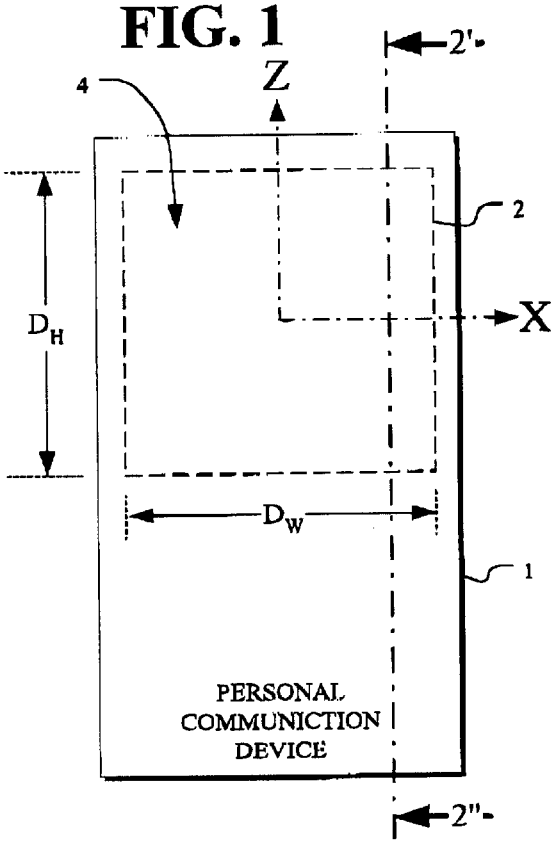
FIG. 1 depicts a wireless communication unit showing by broken line the location of an antenna area.

In FIG. 1, personal communication device 1 is a cell phone, pager or other similar communication device that can be used in close proximity to people. The communication device 1 includes an antenna area 2 for receiving an antenna 4 which receives and/or transmits radio wave radiation from and to the personal communication device 1. In FIG. 1, the antenna area 2 has a width $D_W$ and a height $D_H$. A section line 2'–2" extends from top to bottom of the personal communication device 1.

Figure 2:
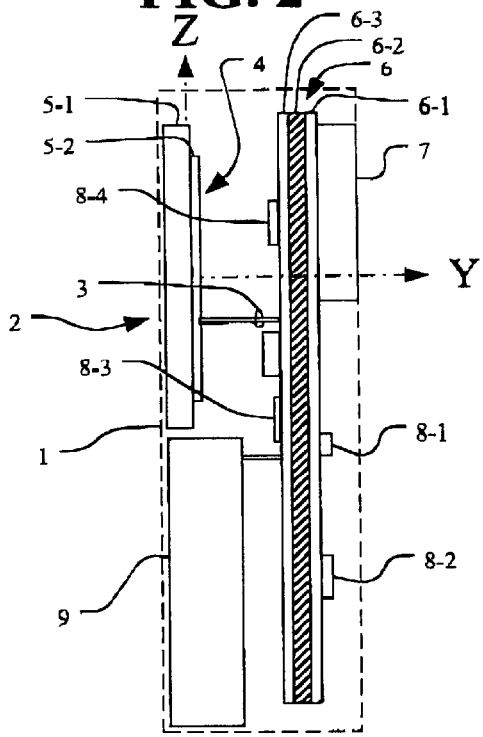
FIG. 2 depicts a schematic, cross-sectional end view of the FIG. 1 communication unit.

In FIG. 2, the personal communication device 1 of FIG. 1 is shown in a schematic, cross-sectional, end view taken along the section line 2'–2" of FIG. 1. In FIG. 2, a printed circuit board 6 includes, by way of example, one conducting layer 6-1, an insulating layer 6-2 and another conducting layer 6-3. The printed circuit board 6 supports the electronic components associated with the communication device 1 including a display 7 and miscellaneous components 8-1, 8-2, 8-3 and 8-4 which are shown as typical. Communication device 1 also includes a battery 9. The antenna assembly 5 includes a substrate 5-1 and a conductive layer 5-2 that forms a loop antenna 4 offset from the printed circuit board 6 by a gap which tends to suppress coupling between the antenna layer 5-2 and the printed circuit board 6. The conductive layer 5-2 is connected to printed circuit board 6 by a coaxial conductor 3. The antenna 4 of FIG. 1 and FIG. 2 is an arrayed-segment loop antenna that has small area so as to fit within the antenna area 2, has acceptably low SAR and exhibits good performance in transmitting and receiving signals.

Figure 3:
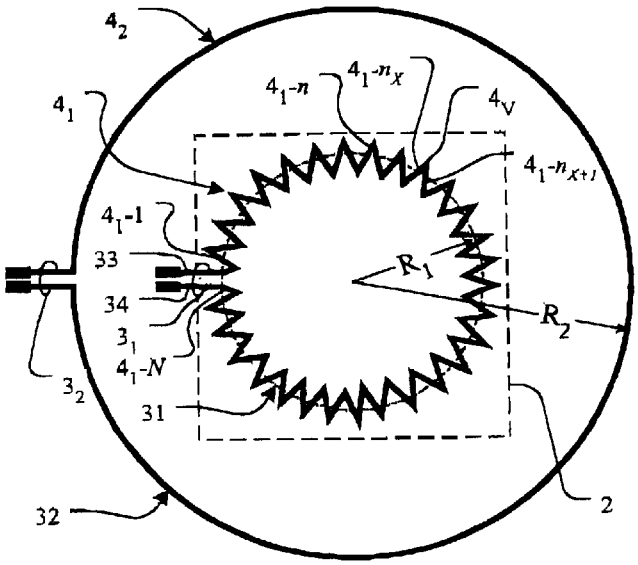
FIG. 3 depicts a top view of a loop antenna with a saw-tooth shaped antenna superimposed over an equivalent-length circular loop antenna, each with matching transmission line feeds.

In FIG. 3, a illustrative antenna $\mathbf{4}_1$, described for analysis purposes, has segments arrayed in a circular sawtooth pattern connected electrically in series and connected by coaxial line $\mathbf{3}_1$ to form a loop antenna. The arrayed sawtooth segments of the loop antenna $\mathbf{4}_1$ fall generally symmetrically on a circle 31 of radius $R_1$ that fits within the antenna area 2, which has been allocated for an antenna, in the communication device 1 of FIG. 1. The antenna $\mathbf{4}_1$ has an actual enclosed area, $\pi(R_1)^2$ and has an electrical length, $A_{t=1}$ of $\pi(2R_2)$ where $\pi(2R_2)$ is significantly longer than the circumference $\pi(2R_1)$ of the circle 31.

In FIG. 3, the antenna $\mathbf{4}_2$ represents antenna $\mathbf{4}_1$ when the antenna $\mathbf{4}_1$ has been stretched-out to a circle having a maximum enclosed area, $\pi(R_2)^2$. The antenna $\mathbf{4}_2$ has a coaxial transmission line $\mathbf{3}_2$ having first and second conductors. The circle formed by antenna $\mathbf{4}_2$ is a virtual circle for antenna $\mathbf{4}_1$. The superimposed maximum enclosed area, $\pi(R_2)^2$ of the antenna $\mathbf{4}_2$ is a virtual maximum area for antenna $\mathbf{4}_1$ over a circle of radius $R_1$. The loop antenna $\mathbf{4}_2$ has a radius $R_2$ that is approximately twice the radius $R_1$ and has an electrical length, $A_{t=2}$ of $\pi(2R_2)$ which is the same as the electrical length of antenna $\mathbf{4}_1$. Accordingly, although the antenna $\mathbf{4}_2$ and antenna $\mathbf{4}_1$ have the same electrical length, the actual enclosed area of antenna $\mathbf{4}_1$ is much smaller than the maximum area enclosed by of antenna $\mathbf{4}_2$. FIG. 3 represents an example of a loop antenna $\mathbf{4}_2$, having a given electrical length, $A_t$, arrayed in a simple plain geometry (in the present example, a circle 32) that does not fit within a designated antenna area 2. The antenna 42 can be converted to an arrayed segment antenna $\mathbf{4}_1$ having the same given electrical length, $A_t$, but with an actual enclosed area small enough to fit within the designated antenna area 2.

When the FIG. 3 antenna $\mathbf{4}_1$ is used for communication devices, the wavelength, $\lambda$, for one or more of the resonant frequencies of interest are such that, for efficient antenna design, the electrical length, $A_t$, cannot be made small with respect to $\lambda$. For this reason, it cannot be assumed for analytical simplicity (as is done for analysis of "small loop" antennas) that the electrical current, i, in the loop of antenna $\mathbf{4}_1$ is in phase when representing the energy fields as a function of location and direction for antenna $\mathbf{4}_1$. Accordingly, the analytical models for showing the fields of the arrayed-segmented antennas is mathematically complex even when the arrayed-segment loop antenna has a high degree of symmetry as in antenna $\mathbf{4}_1$. Even more difficulty of analysis arises when arrayed-segment antennas are irregular, that is, have segment patterns that are arrayed without a high degree of symmetry.

In FIG. 3, the transmission line 3, is a connection means formed of first and second conductors 33 and 34 for non-radiating conduction of electrical current between the circuit board 6 of FIG. 2 and the loop $\mathbf{4}_1$. The loop 4, has a plurality of electrically conducting radiation segments $\mathbf{4}_1$-1, . . . , $\mathbf{4}_1$-n, . . . , $\mathbf{4}_1$-N each having a segment length. The segments $\mathbf{4}_1$-1, . . . , $\mathbf{4}_1$-n, . . . , $\mathbf{4}_1$-N are connected at vertices and in series to form a loop electrically connected between the first and second conductors 33 and 34 of the transmission line. The loop $\mathbf{4}_1$ has an electrical length, $A_t$, that is proportional to the sum of segment lengths for each of the radiation segments $\mathbf{4}_1$-1, . . . , $\mathbf{4}_1$-n, . . . , $\mathbf{4}_1$-N so as to facilitate an exchange of energy at the radiation frequency.

The radiation segments $\mathbf{4}_1$-1, . . . , $\mathbf{4}_1$-n, . . . , $\mathbf{4}_1$-N are arrayed in a sawtooth pattern that tends to juxtapose in close proximity first ones of the segments $\mathbf{4}_1$-$n_x$ conducting electrical current with a component in one direction to a vertices $\mathbf{4}v$ with second ones of the segments $\mathbf{4}_1$-$n_{x+1}$ conducing electrical current at an acute angle in another direction from the vertices $\mathbf{4}_v$. Accordingly, the different segments of antenna $\mathbf{4}_1$ connect at vertices and conduct electrical current in different directions near said vertices.

The loop antenna $\mathbf{4}_1$ of FIG. 3 is represented by a virtual circle of radius $R_2$ having a perimeter length equal to $\pi(2R_2)$ that defines a virtual maximum enclosed area of $\pi(R_2)^2$. The segments $\mathbf{4}_1$-1, . . . , $\mathbf{4}_1$-n, . . . , $\mathbf{4}_1$-N are arrayed in a pattern that has an enclosed area of $\pi(R_1)^2$ that is represented by circle 31 of perimeter equal to $\pi(2R_1)$ that defines a virtual enclosed area of $\pi(R_1)^2$ where $R_1$ *is substantially less than R2* and the virtual enclosed area of $\pi(R_1)^2$ is substantially less than the virtual maximum enclosed area of $\pi(R_1)_2$ but where the electrical length electrical length, $A_1$, of the loop antenna $\mathbf{4}_1$ is approximately equal to $\pi(2R_2)$.

Figure 4:
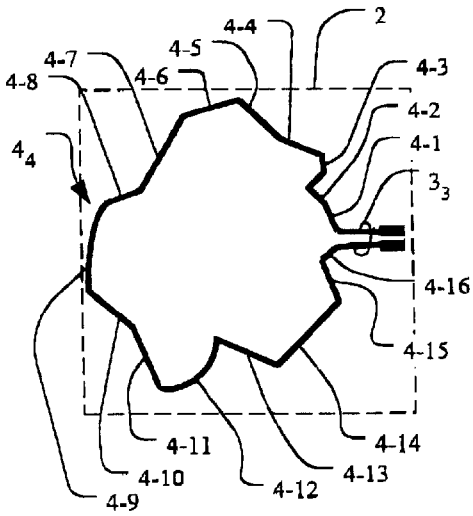
FIG. 4 depicts a top view an irregular-shaped loop antenna.

In FIG. 4, an irregular-shaped arrayed-segment loop antenna $\mathbf{4}_4$ is formed of an array of line segments 4-1, 4-2, . . . , 4-16 connected in electrical series. The loop antenna $\mathbf{4}_4$ includes a coaxial connector $\mathbf{3}_3$ to complete formation of the loop antenna. The loop antenna $\mathbf{4}_4$ fits within the antenna area 2. The segments of the antenna $\mathbf{4}_4$ included straight and curved lines and are arrayed without any particular symmetry. The segments of loop antenna $\mathbf{4}_4$ of FIG. 4 include straight line segments such as 4-1 and 4-2 and include curved line segments such as 4-9 and 4-12. The area of the loop antenna $\mathbf{4}_4$ fits within the antenna area 2 designated for the communication device 1 of FIG. 1.

Figure 5:
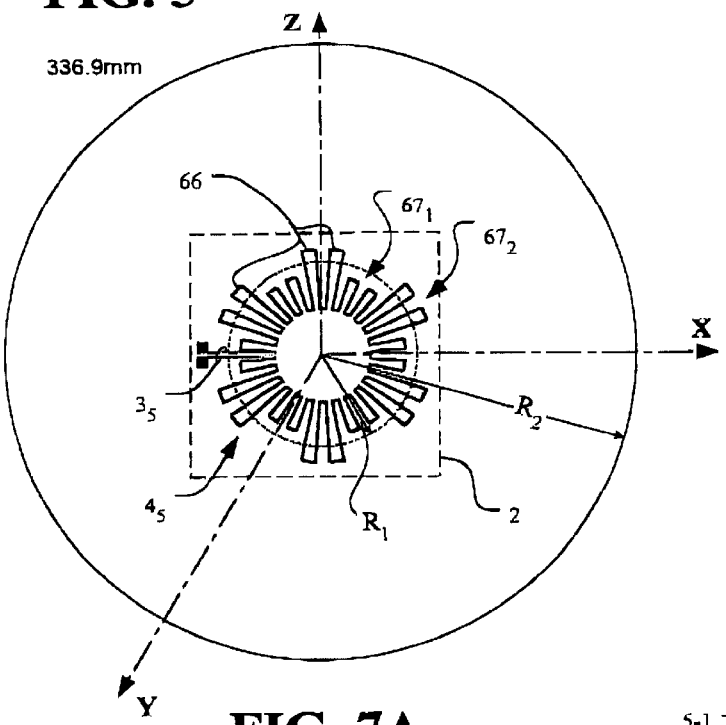
FIG. 5 depicts a top view a loop antenna with a bi-level slat rectangular-tooth shaped antenna within a circle having a perimeter equal to the physical length of the antenna.

In FIG. 5, an arrayed-segment loop antenna $\mathbf{4}_5$, with equivalent radius $R_1$, is shown fitting within the antenna area 2 of the communication device 1 of FIG. 1. The arrayed-segment loop antenna $\mathbf{4}_5$ is formed of twenty-four slats 66 symmetrically arrayed about a circle of radius $R_1$. The slats 66 are paired with alternating pairs, such as pairs $\mathbf{67}_1$ and $\mathbf{67}_2$, of length shorter and longer than an average radius $R_1$. Therefore, for loop antenna $\mathbf{4}_5$, the actual enclosed area is $\pi(R_1)^2$. For loop antenna $\mathbf{4}_5$, the virtual maximum enclosed area (that is, the area that would-be enclosed by the antenna $\mathbf{4}_5$ if stretched out to a circle with a radius of $R_2$) would not fit within the antenna area 2 of the communication device 1 of FIG. 1. In FIG. 5, the loop antenna $\mathbf{4}_5$ lies in the XZ-plane which is the plane of the paper and the Y-plane is normal to the XZ-plane and extends out of the paper. The antenna $\mathbf{4}_5$ has an actual enclosed area, $\pi(R_1)^2$ and has an electrical length, $A_{t=1}$ of $\pi(2R_2)$ where $\pi(2R_2)$ is significantly longer than the circumference $\pi(2R_1)$.

Figure 6:
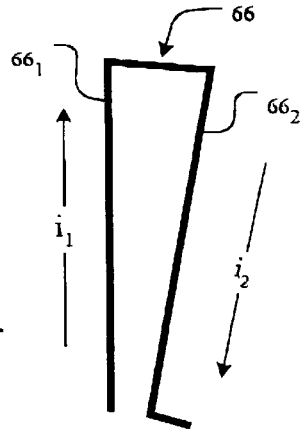
FIG. 6 depicts a top view of one slat of the antenna of FIG. 5.

In FIG. 6, one tooth 66, typical of the of the slats 66 of antenna $\mathbf{4}_5$ of FIG. 5, has a leg $\mathbf{66}_1$ that conducts electrical current $i_1$ in one direction (generally positive Z-axis direction) and another leg $\mathbf{66}_2$ that conducts electrical current $i_2$ in the opposite direction (generally, negative Z-axis direction). The loop $\mathbf{4}_5$ has symmetry resulting from alternating short and long regions, such as by slats $\mathbf{67}_1$ and $\mathbf{67}_2$, of FIG. 5. In FIG. 6, the E field generated by the segment $\mathbf{66}_1$ can be compared with the E field generated by the segment $\mathbf{66}_2$ in the near field normal to the YZ-plane along the X axis. Additionally, the E fields of the short slats, such as slats $\mathbf{67}_1$, can be compared with the E fields of the long slats, such as slats $\mathbf{67}_2$, whether side by side or across the diameter of the circle with radius $R_1$. However, the analysis of fields, even for simple geometries, is difficult. Reference is made to the book, ANTENNAS, by John D. Kraus, Second Addition, CHAPTER 10, SELF AND MUTUAL IMPEDANCES where analysis for short segments of simple geometries is given. Not withstanding the complexity of segment by segment E field analysis, the objective is to array the segments such that the net E field generated in the near field of the antenna is small. Antenna patterns that are effective in having acceptable E field patterns are shown in FIG. 7A through FIG. 12B.

Figure 7A:
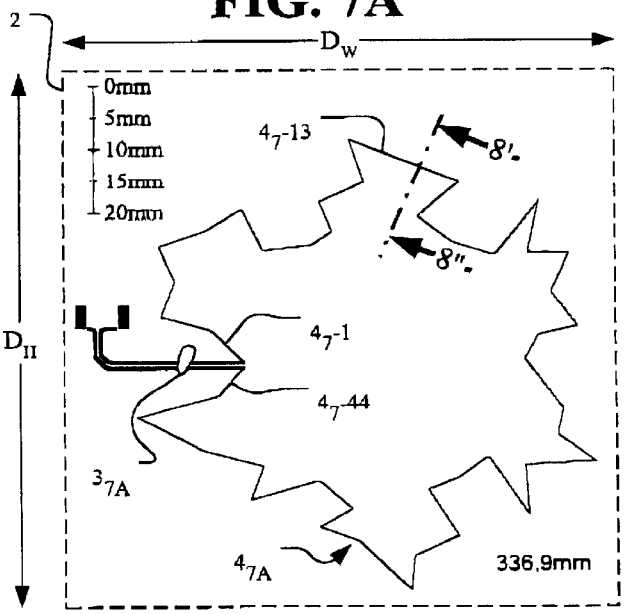
FIG. 7A depicts a top view of an irregular-shaped segmented loop antenna having a length of about 337 mm.

In FIG. 7A, an irregular-shaped arrayed-segment loop antenna $\mathbf{4}_{7A}$ is formed of array of line segments $\mathbf{4}_7$-1, $\mathbf{4}_7$-2, . . . , $\mathbf{4}_7$-44, connected in electrical series and connected to an element $\mathbf{3}_{7A}$. The antenna of FIG. 7 is analyzed in view of the features described in connection with FIG. 3, FIG. 4, FIG. 5 and FIG. 6. In FIG. 7 the loop antenna $\mathbf{4}_7$ includes a coaxial connector $\mathbf{3}_7$ to complete the loop antenna. The loop antenna $\mathbf{4}_7$ fits within the antenna area 2. The segments of the antenna $\mathbf{4}_4$ include straight lines and are arrayed without any particular symmetry. The segments of loop antenna $\mathbf{4}_7$ of FIG. 4 include a straight line segment $\mathbf{4}_7$-13 having a section line 8'–8". The enclosed area of the loop antenna $\mathbf{4}_7$ fits within the antenna area 2 designated for the communication device 1 of FIG. 1. The electrical length, $A_{t=7}$ of loop antenna $\mathbf{4}_7$ is 336.9 mm and fits within an antenna area 2 that measures approximately $D_H$=4 cm and $D_W$=3 cm. The antenna works with the standard GSM frequency bands of 824–894 MHz and 900–940 MHz. Further, the arrayed-segment antennas described in the specification can work anywhere over the small communication device spectrum from 400 MHz to 6000 MHz and over other spectrums.

A frequency of 837 MHz is approximately in the center of the US Cellular mobile transmit band. An antenna with frequency of 837 MHz in free space has a physical length of approximately 358.4 mm. However, an antenna not in free space and mounted on a dielectric substrate has a transmission velocity that is less than the speed of light in free space. With an adjustment for a non-free space environment, in one embodiment, the actual appropriate physical length for a 837 MHz frequency is 336.9 mm. An antenna with 336.9 mm is combined with the antenna leads, or other matching element. The properties of the antenna leads are determined, among other things, based upon the dielectric constant of the material of the antenna substrate.

Figure 7B:
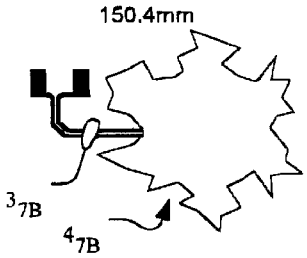
FIG. 7B depicts a top view of an irregular-shaped segmented loop antenna like that of FIG. 7A with a length of about 150 mm.

FIG. 7B depicts a top view of another irregular-shaped loop antenna $\mathbf{4}_{7B}$ like that of FIG. 7A except with a length of about 150 mm and includes a matching element $\mathbf{3}_{7B}$. The 150 mm length of antenna $\mathbf{4}_{7B}$ produces an antenna which has a resonance of approximately 1900 MHz which is the center of the US PCS band.

Figure 8:
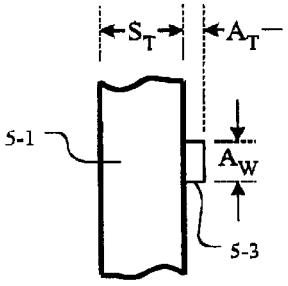
FIG. 8 depicts a cross-sectional view of a segment along the section line 8–8" of FIG. 7A.

In FIG. 8, a schematic sectional view along the section line 8'–8" of FIG. 7 is shown. In the example of FIG. 8, the thickness, $S_T$, of the dielectric substrate 5-1 is approxiamtely 125 $\mu$m, the width, $A_W$, of the segment 5-3 is approximately 0.2 mm, and the thickness, $A_T$, of the segment 5-3 is approximately 35 $\mu$m. A through-hole connector can be employed to connect transmission lines to antenna patterns arrayed on either or both sides of the substrate 5-1 or to interconnect multiple antenna pasterns of either or both sides of substrate 5-1 (not shown).

Figures 9A, 9B, 9C, 10A, 10B, 11A, 11B, 11C:
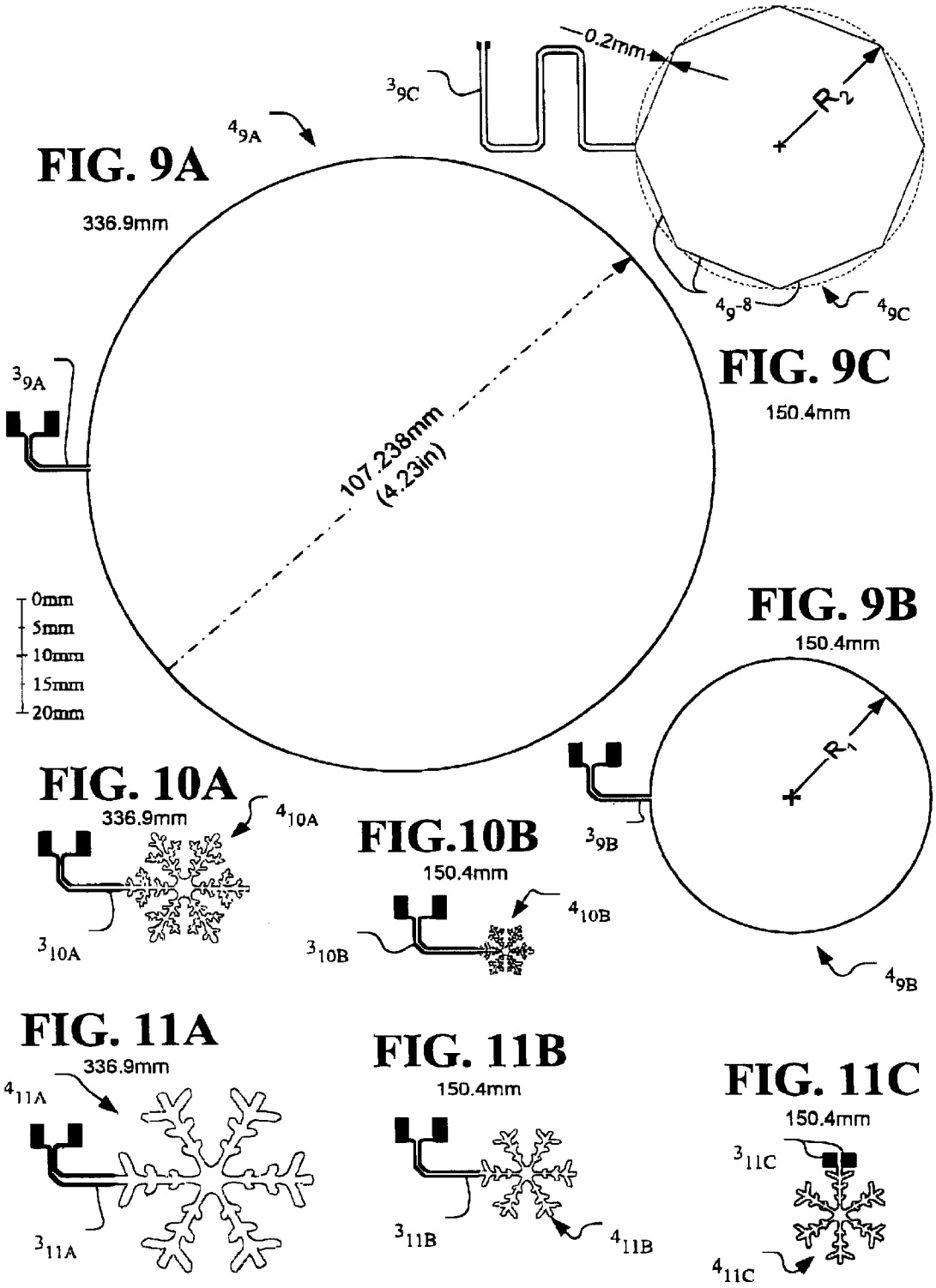
FIG. 9A depicts a top view of a round loop antenna having a length of about 337 mm with a transmission line matching element.
FIG. 9B depicts a top view of a round loop antenna on a substrate having a length of about 150 mm connected to a transmission line matching element.
FIG. 9C depicts a top view of an octagon loop antenna having a length of about 150 mm together with a Q-section transmission line matching element.
FIG. 10A depicts a top view of a snowflake-shaped loop antenna having a radiation length of about 337 mm together with a transmission line matching element.
FIG. 10B depicts a top view of a snowflake-shaped loop antenna having a radiation length of about 150 mm together with a transmission line matching element.
FIG. 11A depicts a top view of a reduced segment count simplified snowflake-shaped loop antenna having a radiation length of about 337 mm together with a transmission line matching element.
FIG. 11B depicts a top view of a reduced segment count snowflake-shaped loop antenna having a radiation length of about 150 mm together with a transmission line matching element.
FIG. 11C depicts a top view of a reduced segment count snowflake-shaped loop antenna having a radiation length of about 150 mm together with contact elements.

FIG. 9A depicts a top view of a round loop antenna $\mathbf{4}_{9A}$ having a length of about 337 mm and a transmission line matching element $\mathbf{3}_{9A}$. The antenna $\mathbf{4}_{9A}$ is drawn approximately to scale and has a diameter of approximately 107.238 mm (4.23 inch) that does not fit within the antenna area 2 of FIG. 1 typical of smaller handheld wireless devices such as portable phones and accordingly is only suitable for use with larger devices. The antenna $\mathbf{4}_{9A}$ is designed for a frequency of 837 MHz and has a physical length of approximately 336.9 mm and is combined with the antenna leads, or equivalent matching element $\mathbf{3}_{9A}$. The properties of the antenna leads and/or the matching network are determined, among other things, based upon the conductors and material of the antenna substrate as discussed in connection with FIG. 8. The antenna of FIG. 9A is, therefore, designed for operation at the center of the US Cellular mobile transmit band.

FIG. 9B depicts a top view of a round loop antenna $\mathbf{4}_{9B}$ having a length of about 150 mm and having a transmission line matching element $\mathbf{3}_{9B}$. The antenna $\mathbf{4}_{9B}$ is designed for a frequency of approximately 1900 MHz and has a physical length of approximately 150 mm and is combined with the antenna leads, or equivalent matching network $\mathbf{3}_{9B}$. The antenna $\mathbf{4}_{9B}$ is, therefore, designed for operation at the center of the US PCS band.

FIG. 9C depicts a top view of an octagon loop antenna $\mathbf{4}_{9C}$ having a length of about 150 mm and having a Q-section transmission line matching element $\mathbf{3}_{9C}$. The radius, $R_2$ of the circle in which the octagon antenna of FIG. 9C is inscribed is equal to about $1.026R_1$, where $R_1$, is the radius of the circle antenna of FIG. 9B using the formula for the perimeter, $P_n$, of an n-sided regular polygon inscribed in a circle of radius $R_2$, $P_n=2nR_2 \sin(\pi/n)$. The antennas of FIGS. 9B and 9C have the same physical length of 150 mm, $R_1$, equals $150/\pi$mm and $R_2$ equals $(1.026)(150/\pi)$mm. The Q-section matching element $\mathbf{3}_{9C}$ is drawn to scale for matching the antenna loop segments $\mathbf{4}_9$-8 impedance to 50 ohms. The antenna loop segments $\mathbf{4}_9$-8 have an impedance of about 130 ohms and the matching element $\mathbf{3}_{9C}$ has an impedance of 80 ohms. Combining the impedance of the segments $\mathbf{4}_9$-8 with the impedance of the matching element $\mathbf{3}_{9C}$ results in the octagon loop antenna $\mathbf{4}_{9C}$ having an impedance of 50 ohms. The calculation of the Q-section matching element impedance, $Z_s$, uses the impedance, $Z_L$, of the antenna loop (130 ohms in FIG. 9C), the impedance, $Z_0$, of the transceiver (50 ohms, see transceiver 15-1 in FIG. 14). The impedance $Z_s$ is the square root of the product of $Z_L$ $Z_0$ which has a length equal to the ¼ wavelength of the resonant frequency. While a Q-section matching element has been described, numerous other matching elements are well known. For example, a series section, transformers and other such devices.

FIG. 10A depicts a top view of a snowflake-shaped loop antenna $\mathbf{4}_{10A}$ having a radiation length of about 337 mm which is the same length as the length of the FIG. 9A antenna. The antenna $\mathbf{4}_{10A}$ has a transmission line matching element $\mathbf{3}_{10A}$ which is not necessarily drawn to scale for matching the impedance of the antenna loop. The different segments of antenna $\mathbf{4}_{10A}$ connect at vertices and conduct electrical current in different directions near said vertices.

FIG. 10B depicts a top view of a snowflake-shaped loop antenna $\mathbf{4}_{10B}$ having a radiation length of about 150 mm which is the same length as the length of the FIG. 9B and FIG. 9C antennas. The antenna $\mathbf{4}_{10B}$ has a transmission line matching element $\mathbf{3}_{10B}$ which is not necessarily drawn to scale for matching the impedance of the antenna loop. The antenna $\mathbf{4}_{10A}$ has a transmission line matching element $\mathbf{3}_{10A}$ which is not necessarily drawn to scale for matching the impedance of the antenna loop. The different segments of antenna $\mathbf{4}_{10B}$ connect at vertices and conduct electrical current in different directions near said vertices.

The scale of the FIG. 10A and FIG. 10B antennas in the drawing is the same as the scale of the antennas of FIG. 9A, FIG. 9B and FIG. 9C. Note that the areas of the FIG. 10A and FIG. 10B antennas are substantially smaller than the areas of the FIG. 10A and FIG. 10B antennas. The arrayed-segment loop antenna $\mathbf{4}_{10A}$, excluding the connection element $\mathbf{3}_{10A}$, fits within a 20 mm square whereas the antenna $\mathbf{4}_{9A}$ only fits within an 108 mm square. The smallness of area results from the presence of many small segments forming the FIG. 10A and FIG. 10B antennas, that is, the FIG. 10A and FIG. 10B antennas have a high segment count with many of the connecting segments reversing direction.

FIG. 11A depicts a top view of a reduced segment count snowflake-shaped loop antenna $\mathbf{4}_{11A}$ having a radiation length of about 337 mm which is the same length as the length of the FIG. 9A antenna. The number of segments (about 280 segments) forming the antenna of FIG. 11A is substantially less than the number of segments forming the antenna of FIG. 10A. While this reduction of segments increases the area covered by the antenna of FIG. 11A relative to the antenna of FIG. 10A, the area is still much less than the area of the antenna of FIG. 9A. The scale of the FIG. 10A and FIG. 11A antennas in the sheet of drawing is the same.

FIG. 11B depicts a top view of a reduced segment count snowflake-shaped loop antenna $\mathbf{4}_{11B}$ having a radiation length of about 150 mm which is the same length as the length of the FIG. 9B and FIG. 9C antennas. The number of segments forming the antenna of FIG. 11B is substantially less than the number of segments forming the antenna of FIG. 10B. While this reduction in the number of segments increases the area covered by the antenna of FIG. 11B relative to the antenna of FIG. 10B, the area is still much less than the areas of the antennas of FIG. 9B and FIG. 9C. The scale of the FIG. 10B and FIG. 11B antennas in the drawing is the same.

FIG. 11C depicts a top view of a reduced segment count snowflake-shaped loop antenna $\mathbf{4}_{11C}$ having a radiation length of about 150.4 mm and a line width of approximately 0.05 mm together with contact elements $\mathbf{3}_{11C}$. The impedance of antenna $\mathbf{4}_{11C}$ is approximately 50 ohms and hence can be connected to a 50 ohm transceiver unit, such as transceiver unit 15-1 in FIG. 14, without need for matching. Accordingly, the contact pad elements $\mathbf{3}_{11C}$ are connection means that provide adequate coupling (physical connector, capacitive, inductive or other coupling), without the addition of a printed transmission line or other matching element, in the connecting element 15-2 of FIG. 14. The different segments of antennas $\mathbf{4}_{11A}$, $\mathbf{4}_{11B}$ and $\mathbf{4}_{11C}$ connect at vertices and conduct electrical current in different directions near the vertices.

FIG. 12A depicts a top view of a koch island fractal-shaped loop antenna $\mathbf{4}_{12A}$ having a radiation length of about 337 mm which is the same length as the length of the FIG. 9A antenna. The antenna $\mathbf{4}_{12A}$ has a transmission line matching element $\mathbf{3}_{12A}$ which is not necessarily drawn to scale for matching the impedance of the antenna loop.

FIG. 12B depicts a top view of a koch island fractal-shaped loop antenna having a radiation length of about 150 mm which is the same length as the length of the FIG. 9B and FIG. 9C antennas. The antenna $\mathbf{4}_{12B}$ has a transmission line matching element $\mathbf{3}_{12B}$ which is not necessarily drawn to scale for matching the impedance of the antenna loop. The different segments of antennas $\mathbf{4}_{12A}$ and $\mathbf{4}_{12B}$ connect at vertices and conduct electrical current in different directions near the vertices.

FIG. 13 depicts a the device of FIG. 1 juxtaposed a person's head at the ear. The arrayed-segment antennas described have low SAR values and hence tend to reduce adsorbed near field radiation.

FIG. 14 depicts the components that form the device of FIG. 1. In particular, the transceiver unit 15-1 is formed by the components 8 mounted on the circuit board 6 of FIG. 2. The matching element 15-2 connects the transceiver unit 15-1 to the antenna loop 15-3. By way of example, the matching element 15-2 corresponds to the transmission line $\mathbf{3}_{7A}$ of FIG. 7A and the antenna loop 15-3 corresponds to the connected arrayed segments $\mathbf{4}_7$-1, $\mathbf{4}_7$-2, . . . , $\mathbf{4}_7$-44 of FIG. 7A. Typically, the impedance of the transceiver unit 14-1 is 50 ohms. In one example based upon the FIG. 9C antenna, the loop $\mathbf{4}_9$-8 segments exhibit an impedance of 130 ohms. The transmission line matching element $\mathbf{3}_{9C}$ equals 80.62 ohms and is achieved by printed parallel conductors having a length of 37.6 mm. Formulas for determining the impedance, $Z_{TL}$, of printed transmission lines are based upon the spacing, D, between the first and second conductors of the transmission line and the width, d, of transmission lines.

The impedance, $Z_{TL}$, of a transmission line is given by the following equation:

$$Z_{TL} = \left(\frac{276}{\varepsilon}\right)\log\frac{D}{a}$$

$$Z_{TL} = \left(\frac{276}{\sqrt{2.5}}\right)\log\frac{D}{a}$$

$$Z_{TL} = (174.6)\log\frac{D}{a}$$

where:

D=distance between transmission line centers a=radius of transmission line (approximately a flat strip of 0.7 mm by 0.036 mm)

∈,=dielectric constant of substrate

For a substrate where the dielectric constant, ∈, is 2.5 and the impedance $Z_{TL}$, is 80.62 ohms, then the FIG. 9C antenna example described has D=1.0 mm and a=0.35 mm.

The spacing, $S_{TL}$, between transmission line conductors of 0.3 mm is given approximately by the following equation:

$$S_{TL}=D-2a$$

Figure 15:
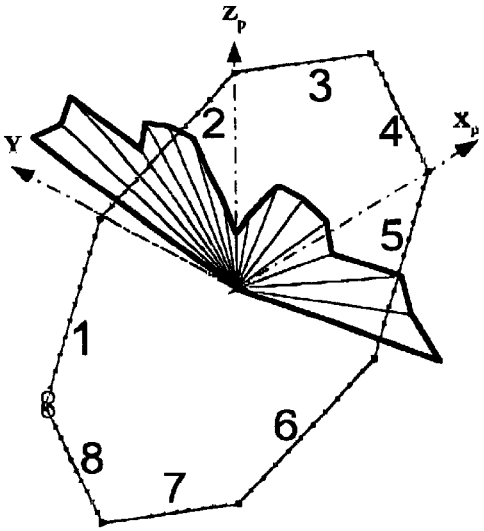
FIG. 15 depicts a perspective view of a 2-D representation of the far field data (in elevation along the Y-axis) for, and superimposed over, the arrayed-segment antenna of FIG. 9C.

FIG. 15 depicts a perspective view of a 2-D representation of the far field model data (in elevation along the Y-axis) for, and superimposed over, the arrayed-segment antenna of FIG. 9C.

Figure 16:
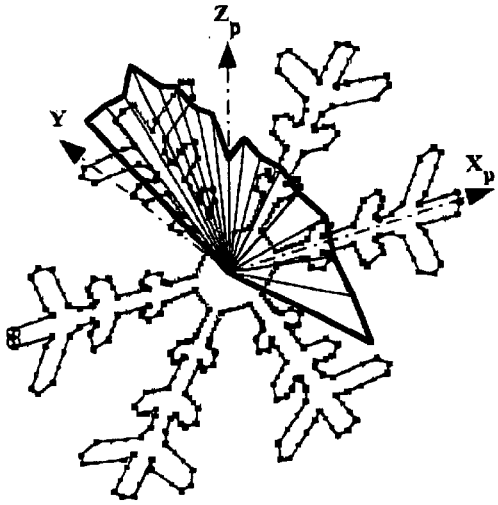
FIG. 16 depicts a perspective view of a 2-D representation of the far field data (in elevation along the Y-axis) for, and superimposed over, the arrayed-segment antenna of FIG. 12B.

FIG. 16 depicts a perspective view of a 2-D representation of the far field model data (in elevation along the Y-axis) for, and superimposed over, the arrayed-segment antenna of FIG. 12B.

Figure 17:
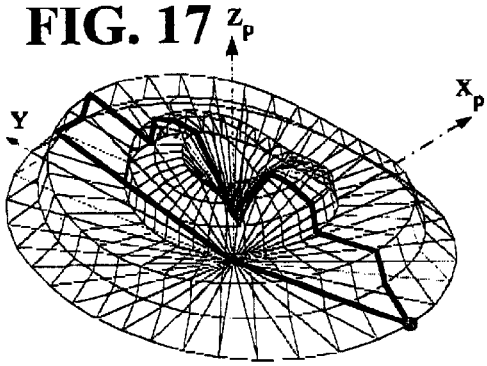
FIG. 17 depicts a perspective view of a 3-D representation of the far field data (in elevation along the Y-axis) for the arrayed-segment antenna of FIG. 9C.

FIG. 17 depicts a perspective view of a 3-D representation of the far field model data (in elevation along the Y-axis) for the arrayed-segment antenna of FIG. 9C.

Figure 18:
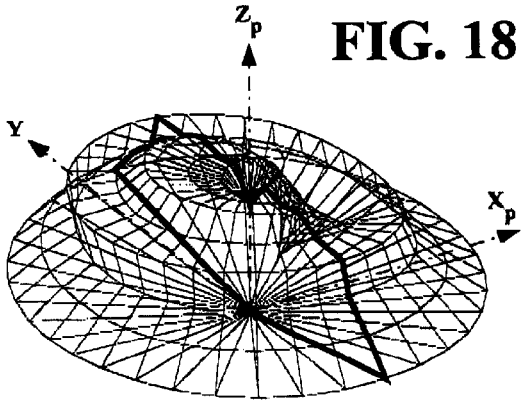
FIG. 18 depicts a perspective view of a 3-D representation of the far field data (in elevation along the Y-axis) for the arrayed-segment antenna of FIG. 12B.

FIG. 18 depicts a perspective view of a 3-D representation of the far field model data (in elevation along the Y-axis) for the arrayed-segment antenna of FIG. 12B.

Figure 19:
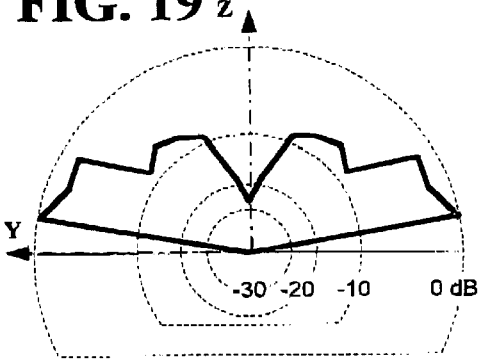
FIG. 19 depicts a view of a 2-D representation of a slice of the FIG. 17 data in the YZ-plane.

FIG. 19 depicts a view of a 2-D representation of a slice of the FIG. 17 data in the YZ-plane.

Figure 20:
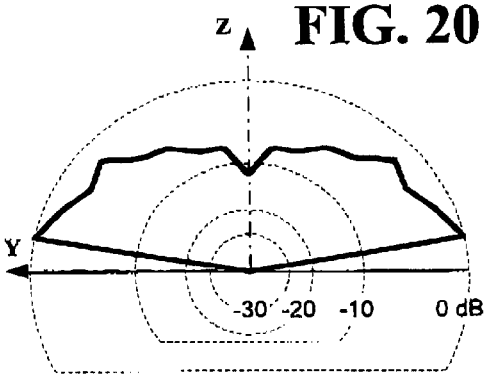
FIG. 20 depicts a view of a 2-D representation of a slice of the FIG. 18 data in the YZ-plane.

FIG. 20 depicts a view of a 2-D representation of a slice of the FIG. 18 data in the YZ-plane.

Figure 21:
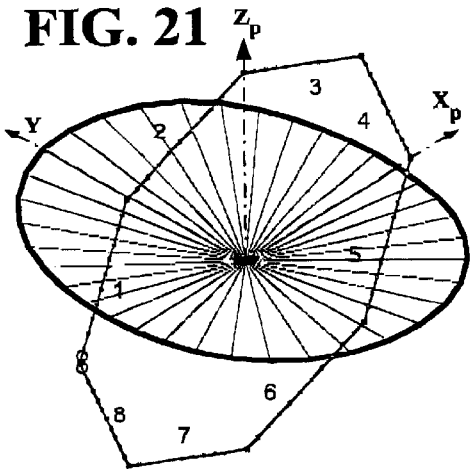
FIG. 21 depicts a perspective view of a 2-D representation of the far field data (in the $X_pZ_p$-plane) for, and superimposed over, the arrayed-segment antenna of FIG. 9C.

FIG. 21 depicts a perspective view of a 2-D representation of the far field model data (in the $X_pZ_p$-plane) for, and superimposed over, the arrayed-segment antenna of FIG. 9C.

Figure 22:
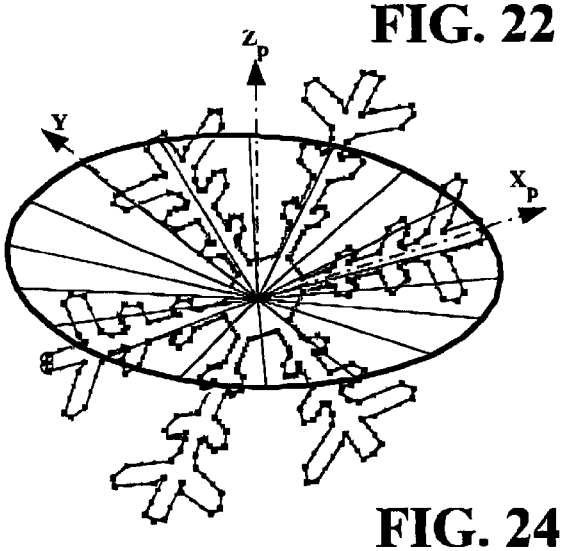
FIG. 22 depicts a perspective view of a 2-D representation of the far field data (in the $X_pZ_p$-plane) for, and superimposed over, the arrayed-segment antenna of FIG. 12B.

FIG. 22 depicts a perspective view of a 2-D representation of the far field model data (in the $X_pZ_p$-plane) for, and superimposed over, the arrayed-segment antenna of FIG. 12B.

Figure 23:
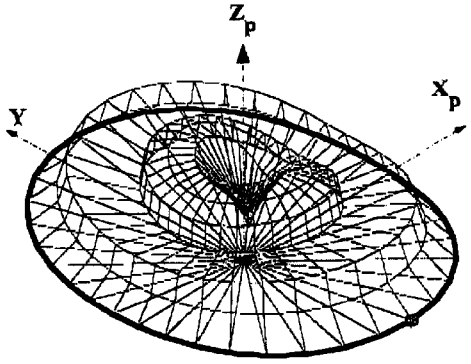
FIG. 23 depicts a perspective view of a 3-D representation of the far field data (in the $X_pY$-plane highlighted) for the arrayed-segment antenna of FIG. 9C.

FIG. 23 depicts a perspective view of a 3-D representation of the far field model data (in the $X_pY$-plane highlighted) for the arrayed-segment antenna of FIG. 9C.

Figure 24:
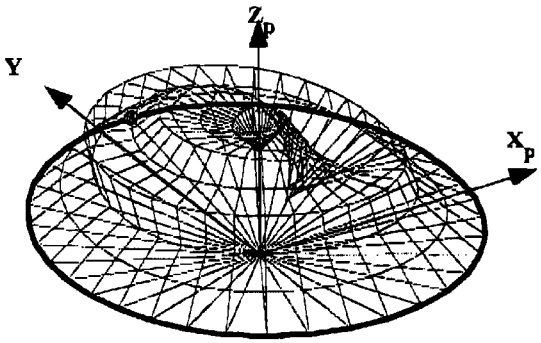
FIG. 24 depicts a perspective view of a 2-D representation of the far field data (in the $X_pY$-plane highlighted) for the arrayed-segment antenna of FIG. 12B
Figure 25:
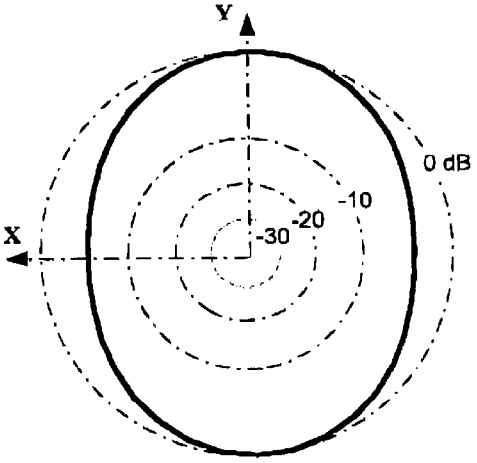
FIG. 25 depicts a view of a 2-D representation of the far field data of FIG. 23.

FIG. 24 depicts a perspective view of a 2-D representation of the far field model data (in the $X_pY$-plane highlighted) for the arrayed-segment antenna of FIG. 12B FIG. 25 depicts a view of a 2-D representation of the far field model data of FIG. 23.

Figure 26:
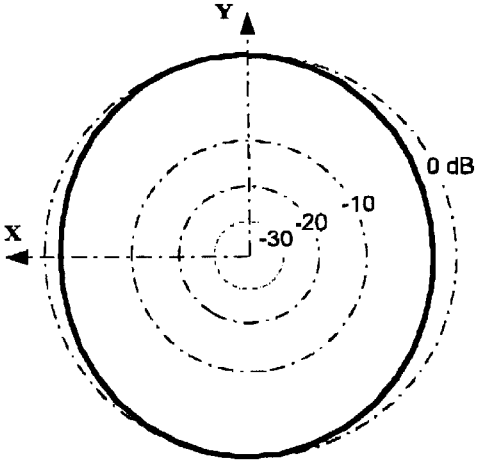
FIG. 26 depicts a view of a 2-D representation of the far field data of FIG. 24.

FIG. 26 depicts a view of a 2-D representation of the far field model data of FIG. 24.

Figure 27:
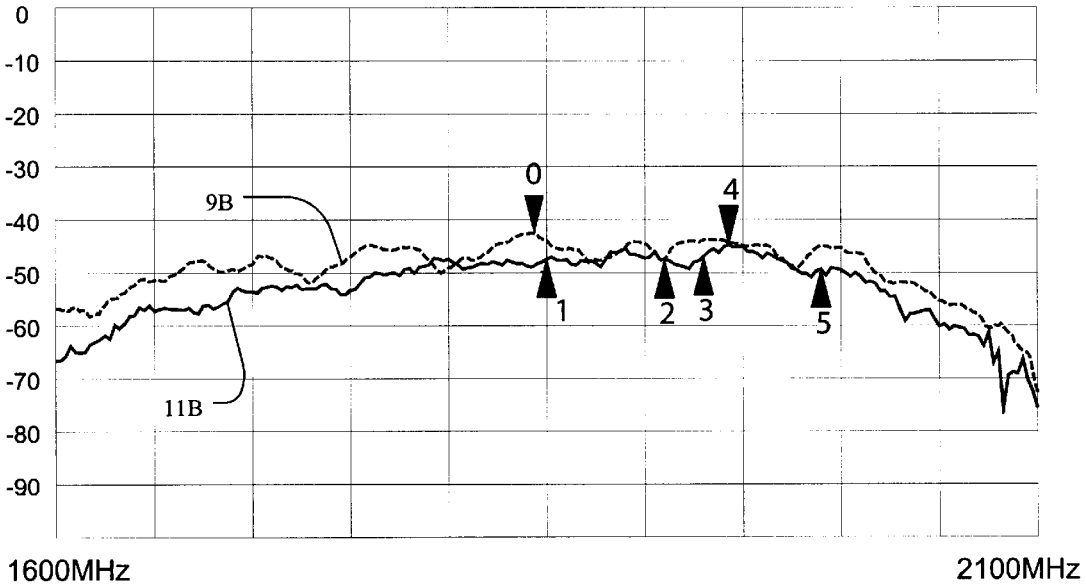
FIG. 27 depicts a graph of the measured far field strength for the antennas of FIG. 9B and FIG. 11B.

FIG. 27 depicts an HP Network analyzer plot of the $Log_{10}$ magnitude of the far field (measured at 10 meters) of simplified snowflake antenna of FIG. 11B and circle/octagon loop antennas of FIG. 9B and FIG. 9C. Data extracted from FIG. 27 is presented for comparison in the following TABLE 1. Note in TABLE 2 that the simplified snowflake segmented-array antenna of FIG. 11B has essentially the same good performance as the circle/octagon loop antennas of FIG. 9B and FIG. 9C.

TABLE 1

| | FREQUENCY | log MAG-9B | log MAG-11B |
|---|---|---|---|
| 0 | 1842.500000 MHz | | −42.652 dB |
| 1 | 1850 MHz | −47.279 dB | −44.111 dB |
| 2 | 1910 MHz | −47.402 dB | −47.425 dB |
| 3 | 1930 MHz | −46.863 dB | −43.956 dB |
| 4 | 1943.000033 MHz | −44.807 dB | |
| 5 | 1990 MHz | −49.256 dB | −45.134 dB |

Actual field data for antennas are shown in the following TABLE 2. In TABLE 2 the #1, #2 and #3 used a full 600 milliwatt signal generator in free space whereas #4 and #5 used the maximum power output of Nokia 8260 as measured through the circuit board and ear piece.

TABLE 2

| | Antenna | SAR(1 g) 836 MHz | SAR(1 g) 1900 MHz |
|---|---|---|---|
| #1 | Dipole | 7.3 mW/g | 8.94 mW/g |
| #2 | Circular Loop ($4_{9B}$) | | 4.75 mW/g |
| #3 | Uniform Slat Loop ($4_5$ variant) | 2.74 mW/g | |
| #4 | Nokia 8260-Planar Stock | 0.701 mW/g | |
| #5 | Nokia 8260-Snowflake ($4_{10A}$) | 0.556 mW/g | |

As indicated in TABLE 2, the SAR for linear antennas (e.g. #Dipole) is significantly greater than the SAR for loop antennas (#2, #3 and #5). From TABLE 2, the SAR for loops with many segments (#3 and #5) is somewhat lower than that of simple circular loops (#2) and much lower than simple dipole (#1). A 20% difference is present between the Nokia 8260-Snowflake (#5) that is an otherwise stock Nokia wireless phone modified to have a reduced count snowflake antenna of FIG. 10A, and a stock Nokia 8260 Planar wireless phone (#4) with a standard planar antenna. The difference between circular (FIG. 9), slat (FIG. 5), irregular (FIG. 4 and FIG. 7), snowflake (FIG. 10 and FIG. 11) and other arrayed-segment antenna loops with respect to linear antennas such as a dipole (or monopole whip/stubby as found on many phones) is even greater.

The reasons why arrayed-segment antennas have lower SAR are not easily analyzed. Many factors may contribute to low SAR and other good performance. For example, the arrayed-segment antennas have sharp corners (vertices) where one particular segment is connected to another and reverses direction relative to the segment to which it connects. For an n-segmented loop, there are about n peak radiation vertices where current direction changes. Further, such vertices of a arrayed-segmented loop are spread out over the area of the loop, which has the effect of creating many point sources, as distinguished from the one or two point sources found on linear antennas (for example, two vertices on dipole antennas). In the arrayed-segment antennas, SAR measured over a small area is reduced while the antenna's far-field gain is not significantly affected because the many point sources spread the radiation over a relatively larger area.

Figure 28:
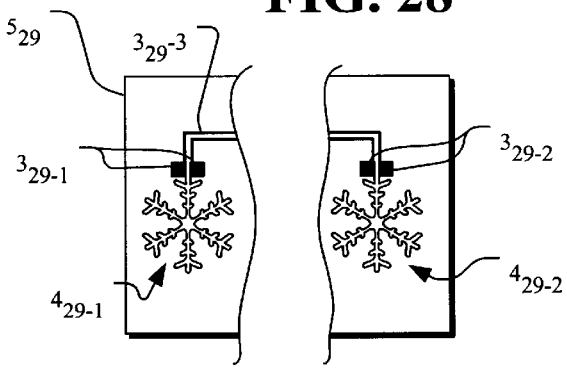
FIG. 28 depicts a top view of an antenna having two or more antenna loops on a common substrate.

FIG. 28 depicts a top view of reduced segment count snowflake-shaped loop antennas $\mathbf{4}_{29}$-1 and $\mathbf{4}_{29}$-2 on a common substrate $\mathbf{5}_{29}$, each having a radiation length of about 150.4 mm and a line width of approximately 0.05 mm, together with contact elements $\mathbf{3}_{29}$-1 and $\mathbf{3}_{29}$-1, respectively. The contact elements $\mathbf{3}_{29}$-1 and $\mathbf{3}_{29}$-1 are connected together, or are separately connected, to the transceiver unit 15-1 of FIG. 14 through a common connecting element 15-2 or through separate connecting elements of the element 15-2 type. The loop antennas $\mathbf{4}_{29}$-1 and $\mathbf{4}_{29}$-2 are like the antenna $\mathbf{4}_{11C}$ of FIG. 11C. While FIG. 28 explicitly depicts two snowflake-shaped loop antennas $\mathbf{4}_{29}$-1 and $\mathbf{4}_{29}$-2, any number of loops may be included on the same or different substrates for inclusion in the same communication device.

While the invention has been particularly shown and described with reference to preferred embodiments thereof it will be understood by those skilled in the art that various changes in form and details may be made therein without departing from the scope of the invention.

What is claimed is:

1. A loop antenna, for use with a communication device, operating for exchanging energy at a radiation frequency, comprising, connection means having first and second conductors for conduction of electrical current, a radiation loop including a plurality of electrically conducting segments each having a segment length where, said segments are electrically connected in series between said first and second conductors for exchange of energy at the radiation frequency, said loop having an electrical length, $A_l$ that is proportional to the sum of segment lengths for each of said radiation segments, said segments are arrayed in three or more multiple divergent directions that form an irregular pattern and that tend to increase the loop antenna electrical length while permitting the overall outside dimensions of the antenna to fit within an antenna area of said communication device, said segments are arrayed in a pattern to form a loop where different segments connect at vertices and conduct electrical current in different directions near said vertices.

2. The loop antenna of claim 1 wherein said connection means is a transmission line for non-radiation conduction.

3. The loop antenna of claim 2 wherein said connection means includes contact areas for coupling to a transceiver of said communication device.

4. The loop antenna of claim 1 wherein said radiation loop has one impedance value and said transmission line has a compensating impedance value whereby the combined impedance value of the loop antenna equals a predetermined impedance value.

5. The loop antenna of claim 4 wherein said predetermined impedance value is 50 ohms.

6. The loop antenna of claim 1 wherein said radiation loop has a loop impedance value equal to a predetermined impedance value.

7. The loop antenna of claim 6 wherein said predetermined impedance value is 50 ohms.

8. The loop antenna of claim 1 wherein said radiation loop has snowflake shape wherein said segments are arrayed in a snowflake pattern.

9. The loop antenna of claim 8 wherein said snowflake pattern is formed of approximately 280 of said segments.

10. The loop antenna of claim 1 wherein said segments include straight and curved segments.

11. The loop antenna of claim 1 wherein said segments are formed of a conductor on a flexible dielectric substrate.

12. The loop antenna of claim 1 wherein said connection means is a transmission line for non-radiation conduction and wherein said segments and said transmission line are formed of conductors on a flexible dielectric substrate.

13. The loop antenna of claim 1 wherein said radiation loop transmits and receives radiation.

14. The loop antenna of claim 13 wherein said radiation loop transmits and receives radiation in the US PCS band.

15. The loop antenna of claim 13 wherein said radiation loop transmits and receives radiation in the US Cellular band.

16. The loop antenna of claim 13 wherein said radiation loop transmits and receives radiation in the spectrum from 400 MHz to 6000 MHZ.

17. A loop antenna, for use with a communication device, operating for exchanging energy at one or more radiation frequencies, comprising, connection means having two or more conductors for coupling of electrical current, a plurality of radiation loops, each of said loops including a plurality of electrically conducting segments each having a segment length where, said segments are electrically connected in series between ones of said conductors for exchange of energy at one of said radiation frequencies, said loop having an electrical length, $A_l$ that is proportional to the sum of segment lengths for each of said radiation segments, said segments are arrayed in a pattern to form a loop antenna having an irregular shape where different segments connect at vertices and conduct electrical current in different directions near said vertices and where said segments are arrayed in an irregular pattern.

18. A loop antenna, for use with a communication device having an antenna area, for exchanging energy at a radiation frequency, comprising, a transmission line having first and second conductors for non-radiating conduction of electrical current, a plurality of electrically conducting segments each having a segment length where, said segments are connected in series to form a loop electrically connected between said first and second conductors where said loop has an electrical length, $A_l$ that is proportional to the sum of segment lengths for each of said segments and that facilitates exchange of energy at the radiation frequency, and where said loop is represented by a virtual circle of radius $R_2$ having a perimeter length equal to $\pi(2R_2)$ that defines a virtual maximum second enclosed area of $\pi(R_2)^2$, said segments are arrayed in a pattern to form a loop antenna having an irregular shape that has an enclosed area of $\pi(R_1)^2$ that is represented by a circle of perimeter equal to $\pi(2R_1)$ that defines a virtual first enclosed area of $\pi(R_1)^2$ where $R_1$ is substantially less than $R_2$ and the virtual first enclosed area of $\pi(R_1)^2$ is substantially less than the virtual maximum second enclosed area of $\pi(R_2)^2$ but where the electrical length, $A_l$, is proportional approximately to $\pi(2R_2)$.

19. A loop antenna, for use with a communication device having an antenna area, for exchanging energy at a radiation frequency, comprising, a base for supporting said antenna within said antenna area, a transmission line mounted on said base and having first and second conductors for non-radiating conduction of electrical current, a plurality of electrically conducting segments mounted on said base, each segment having a segment length where, said segments are connected in series to form a loop electrically connected between said first and second conductors where said loop has an electrical length, $A_l$ that is proportional to the sum of segment lengths for each of said segments and that facilitates exchange of energy at the radiation frequency, and where said loop is represented by a virtual circle of radius $R_2$ having a perimeter length equal to $\pi(2R_2)$ that defines a virtual maximum second enclosed area of $\pi(R_2)^2$, said segments are arrayed in a pattern to form a loop antenna having an irregular shape that has an enclosed area of $\pi(R_1)^2$ that is represented by a circle of perimeter equal to $\pi(2R_1)$ that defines a virtual first enclosed area of $\pi(R_1)^2$ where $R_1$ is substantially less than $R_2$ and the virtual first enclosed area of $\pi(R_1)^2$ is substantially less than the virtual maximum second enclosed area of $\pi(R_2)^2$ but where the electrical length, $A_l$, is proportional approximately to $\pi(2R_2)$.

20. A loop antenna, for use with a communication device having an antenna area, for exchanging energy at a radiation frequency, comprising, a base for supporting said antenna within said antenna area, a transmission line mounted on said base and having first and second conductors for non-radiating conduction of electrical current, a plurality of electrically conducting segments mounted on said base, each segment having a segment length where, said segments are connected in series to form a loop electrically connected between said first and second conductors where said loop has an electrical length, $A_l$ that is proportional to the sum of segment lengths for each of said segments and that facilitates exchange of energy at the radiation frequency, and where said loop is represented by a virtual circle of radius $R_2$ having a perimeter length equal to $\pi(2R_2)$ that defines a first virtual maximum enclosed area of $\pi(R_2)^2$, said segments are arrayed in a pattern to form a loop antenna having an irregular shape that has an enclosed area of $\pi(R_1)^2$ that is represented by a circle of perimeter equal to $\pi(2R_1)$ that defines a virtual first enclosed area of $\pi(R_1)^2$ where $R_1$ is substantially less than $R_2$ and the virtual first enclosed area of $\pi(R_1)^2$ is substantially less than the virtual maximum second enclosed area of $\pi(R_2)^2$ but where the electrical length, $A_l$, is proportional approximately to $\pi(2R_2)$, said segments arrayed to reduce the E field magnitude whereby low SAR is achieved in said particular direction.

21. A loop antenna, for use with a communication device, operating for exchanging energy at a radiation frequency, comprising, connection means having first and second conductors for conduction of electrical current, a radiation loop including a plurality of electrically conducting segments each having a segment length where, said segments are electrically connected in series between said first and second conductors for exchange of energy at the radiation frequency, said loop having an electrical length, $A_l$ that is proportional to the sum of segment lengths for each of said radiation segments, said segments are arrayed in an irregular pattern to form a loop antenna where different segments connect at vertices and conduct electrical current in a number of irregular and different directions.

* * * * *